US007828407B2

(12) United States Patent
Gomez et al.

(10) Patent No.: US 7,828,407 B2
(45) Date of Patent: Nov. 9, 2010

(54) PRINTHEAD SPITTOON

(75) Inventors: Antonio Gomez, Vancouver, WA (US); Russell P. Yearout, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 872 days.

(21) Appl. No.: 11/731,168

(22) Filed: Mar. 30, 2007

(65) Prior Publication Data

US 2008/0238993 A1 Oct. 2, 2008

(51) Int. Cl.
*B41J 2/165* (2006.01)

(52) U.S. Cl. ..... 347/22; 347/36

(58) Field of Classification Search ..... 347/22–23, 347/29–36

See application file for complete search history.

(56) References Cited

U.S. PATENT DOCUMENTS

| | | | | |
|---|---|---|---|---|
| 5,663,751 | A | 9/1997 | Holbrook | |
| 6,203,135 | B1 | 3/2001 | Murcia et al. | |
| 6,328,411 | B1 | 12/2001 | Taylor et al. | |
| 6,481,822 | B2 | 11/2002 | Murcia et al. | |
| 6,533,377 | B2 * | 3/2003 | Su et al. | 347/22 |
| 6,572,292 | B2 | 6/2003 | Kelley et al. | |
| 6,601,942 | B2 | 8/2003 | Taylor et al. | |
| 6,669,325 | B2 | 12/2003 | Fredrickson et al. | |
| 6,785,495 | B2 * | 8/2004 | Baker et al. | 399/249 |
| 6,932,455 | B2 * | 8/2005 | Monclus et al. | 347/22 |
| 6,981,756 | B2 | 1/2006 | Fredrickson et al. | |
| 2001/0012027 | A1 | 8/2001 | Murcia et al. | |
| 2002/0008727 | A1 | 1/2002 | Tayor et al. | |
| 2002/0164191 | A1 | 11/2002 | Kelley et al. | |
| 2003/0128250 | A1 | 7/2003 | Booth | |
| 2004/0257397 | A1 | 12/2004 | Gomez et al. | |
| 2005/0093946 | A1 | 5/2005 | Tanner et al. | |
| 2006/0232623 | A1 | 10/2006 | Murcia et al. | |

FOREIGN PATENT DOCUMENTS

| | | |
|---|---|---|
| GB | 2381239 A | 4/2003 |
| GB | 2410216 A | 7/2005 |

* cited by examiner

*Primary Examiner*—Juanita D Stephens

(57) ABSTRACT

A printing system includes a printhead; a print drum for transporting print media in the printing system including to the printhead; and a spittoon disposed on the print drum for receiving ink from a spitting operation of the printhead. A method of performing a spitting operation for a printhead includes rotating a print drum with respect to the printhead, where the drum comprises a spittoon disposed on the drum for receiving ink ejected from the printhead during the spitting operation; aligning the spittoon on the drum with the printhead; and spitting ink with the printhead to the spittoon.

20 Claims, 5 Drawing Sheets

PRINTHEAD SPITTOON

BACKGROUND

Drum-based printing systems frequently offer an effective solution to speed and reliability requirements imposed by mass printing applications. Accordingly, during recent years these printing systems have undergone a trend of continually increasing popularity and demand.

Many drum-based printing systems incorporate printheads designed to eject tiny droplets of liquid ink. In such systems, print media are typically loaded onto a drum and rotated past the printheads. As the print media rotates by the printheads, the printheads deposit the ink droplets on the print media in a specific pattern to form a desired image on the print media.

To obtain and maintain good printed image quality, many printheads require periodic cleaning to flush drying ink from the printhead nozzles. This periodic cleaning is known as decap spitting or decapping.

Decap spitting operations are generally performed by ejecting a number of ink droplets through the nozzles of the printheads into a special receptacle, known as a spittoon. The decap spitting operations in the printheads help maintain acceptable quality in printed products by ensuring that the first few drops ejected from each nozzle have an adequate trajectory and satisfactory optical density.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Figure 1:
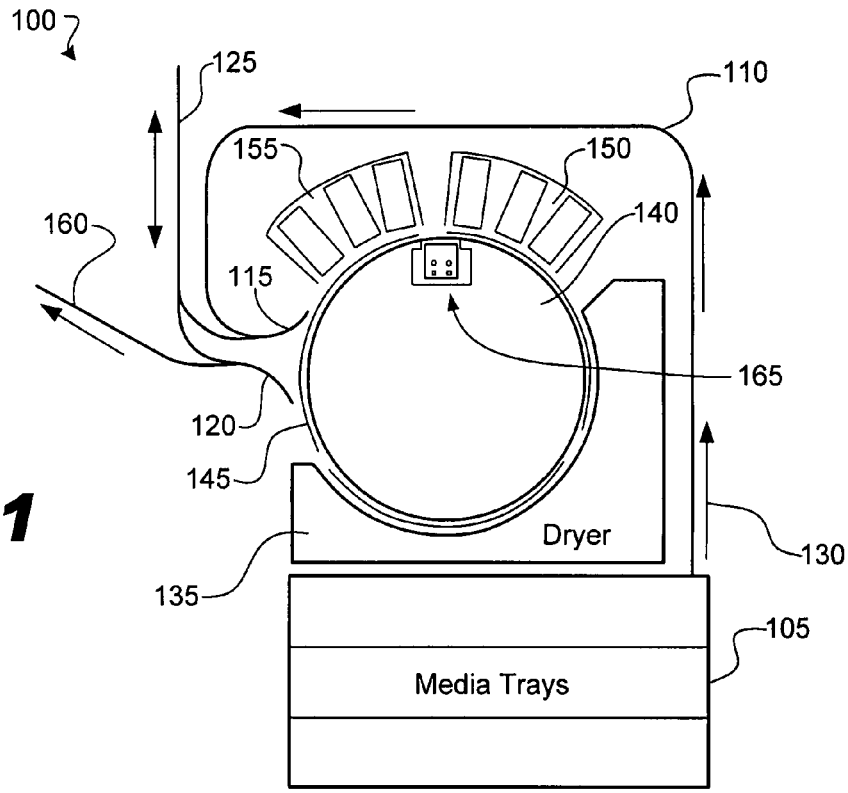
FIG. 1 is a diagram of an exemplary printing system according to principles described herein.

As indicated above, in the case of printing devices incorporating liquid ink printheads and a cyclic multi-page transport drum for print media, it is desirable to maximize printhead health and printing quality by periodically cleansing the printhead nozzles by spitting or decapping. However, it is also desirable to maintain maximum printing throughput. Consequently, it may be undesirable to interrupt printing by moving the printheads to a position off the drum in order to perform the necessary decap spitting. Doing so may considerably reduce throughput and affect image quality due to decreased precision in carriage positioning.

To address the issue of maximizing printhead health and print quality in drum-based printing systems without significantly reducing throughput, the present specification describes exemplary systems and devices relating to a replaceable printer spittoon. The replaceable printer spittoon is disposed within a recess of a print drum and includes a system of rollers configured to provide a clean, absorbent material to the printhead for decap spitting.

As used in the present specification and in the appended claims, the terms "drum," "printing drum," and corresponding derivatives refer to a cylindrical cyclical transport apparatus configured to rotate print media through different phases of a printing process. In at least some embodiments, the drum may be large enough to accommodate multiple sheets of a print medium simultaneously.

As used in the present specification and in the appended claims, the term "printhead" refers to a device configured to eject droplets of liquid ink from a reservoir through at least one nozzle onto a medium. For example, the term printhead includes inkjet printheads such as, but not limited to, piezoelectric, thermal, on-axis and off-axis inkjet printheads.

As used in the present specification and in the appended claims, the terms "spit," "spit operations," "decap" or "decap operations" refer to the process of ejecting a number of ink droplets from a printhead to flush drying ink from printhead nozzles.

As used in the present specification and in the appended claims, the term "spittoon" refers to any receptacle configured to collect ink droplets ejected from a printhead during spitting or decapping operations.

As will be appreciated by those skilled in the art, a wide variety of different print media may be used with the spitting printer or printing system described herein. Such print media may include, but are not limited to; paper, paper-based print media, cardstock, vinyl, linen-based print media, etc.

In the following description, for purposes of explanation, numerous specific details are set forth in order to provide a thorough understanding of the present systems and methods. It will be apparent, however, to one skilled in the art that the present systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

Exemplary Printing System

Referring now to FIG. 1, a front view diagram of an exemplary drum-based inkjet printing system (100) is shown. At the center of the system (100) is a rotating cylindrical drum (140). The drum (140) is configured to receive print media (145) and rotate the media (145) through various phases of the printing process. In this particular embodiment, up to three sheets of media (145) may be loaded in portrait orientation to the drum periphery by means of a partial vacuum created in the interior of the drum (140).

The partial vacuum may hold the print media (145) to the periphery of the drum (140) throughout printing and drying. Upon completion of the printing and drying processes, the print media (145) may then be unloaded from the drum (140) using "cat scratchers," or small teeth that fit into grooves on the drum (140) and lift the page off of the drum (140).

The drum (140) may be fed print media (145) through an extended media path (130) in which sheets of print media (145) stored in media trays (105) are retrieved and transported to the drum (140) where they are deskewed and staged for drum mounting. In some embodiments, two or more different sheets of the print medium (145) may be mounted on the drum (140) in a single revolution. In other embodiments, only one sheet of print medium (145) may be mounted on the drum (140) for each revolution of the drum (140)

The sheets of print media (145) mounted on the drum (140) may be rotated underneath an overhanging array of inkjet print heads (150, 155) for ink application. The inkjet printheads (150, 155) deposit liquid ink droplets on the print media (145) selectively to create images and/or text on the print media (145). In some embodiments, the array of inkjet printheads (150, 155) may span the width of print media (145). In other embodiments, the inkjet printheads (150, 155) may scan or move across the face of the media (145) to deposit the ink droplets.

A replaceable printhead spittoon (165) may be disposed within a slot or recess in the drum (140). The spittoon (165) may include an absorbent material configured to absorb droplets of liquid ink ejected by the inkjet printheads (150, 155) during decap spitting operations. The spittoon (165) may position clean, absorbent material close to the printheads (150, 155) as the portion of the outer periphery of the drum (140) bearing the spittoon (165) is rotated underneath the inkjet printheads (150, 155).

Different factors may affect how often spitting operations are performed by the printheads (150, 155). In some embodiments, the printheads (150, 155) may spit liquid ink on the spittoon (165) as little as once per print job. In other embodiments, spitting operations may be performed by the printheads (150, 155) a plurality of times during a print job. Often factors such as print quality, page content, ink usage, number of pages, and other factors, may be used to determine the frequency of spitting operations by the printheads (150, 155).

The replaceable printhead spittoon (165) may include a rolled sheet of the absorbent material onto which the printheads (150, 155) spit. The spittoon (165) is then configured to manipulate the sheet of absorbent material along a spit roller such that material soiled by liquid ink from printhead spitting operations is advanced to a collection roller, as will be described in more detail in later figures. In this way, clean, absorbent material may be provided to the printheads (150, 155) to receive liquid ink from spitting operations. A continuous supply of clean, absorbent material may reduce the probability that liquid ink from spitting operations will soil the drum (140) and/or print media (145).

As the drum (140) continues rotating, the sheets of media (145) may pass through a dryer (135). The dryer may use hot air convection to dry the wet print media (145). If the sheet of media (145) has finished the printing process, it may then be unloaded from the drum (140). For a one-sided sheet or the second side of a duplex sheet, offloading may be to an output media path (160) and onto either a tray or finisher device. For the first side of a duplex sheet, offloading is to a one-sheet turnaround path (125) that flips the sheet and stages it for remounting to the drum (140). Different sheets of media (145) may remain on the drum (140) for varying amounts of time before being unloaded from the drum (140), depending on the content of the pages to be printed.

In some embodiments, print media may undergo two or more rotations beneath the printheads (150, 155) with ink deposition being divided between each of the passes to promote better ink deposition and resulting image quality. Depending on ink density and color configuration, a sheet of print media (145) may also require from one to several passes through the dryer (135) to adequately dry the liquid ink to the point that problems such as jamming, ink smearing, cockle, and wetness may be avoided.

An additional factor that may affect the amount of time a sheet of print media (145) remains on the drum (140) is known as printhead indexing. For some pages in some embodiments, it may be desirable to shift the physical printhead location between passes so that different printhead nozzles address any given page location. In this way, nozzle errors are averaged out and printheads (150, 155) may last longer. This shift or "indexing" of the printheads (150, 155) may require an additional rotation, i.e., additional time for the print media (145) to be on the drum (140) to complete printing.

Furthermore, the amount of time a sheet of print media (145) remains on the drum (140) may be affected by printhead spitting. It may be desirable in some embodiments to perform a decap spitting operation with the printheads (150, 155) between passes of a single sheet of print media past the printheads (150, 155).

Figure 2:
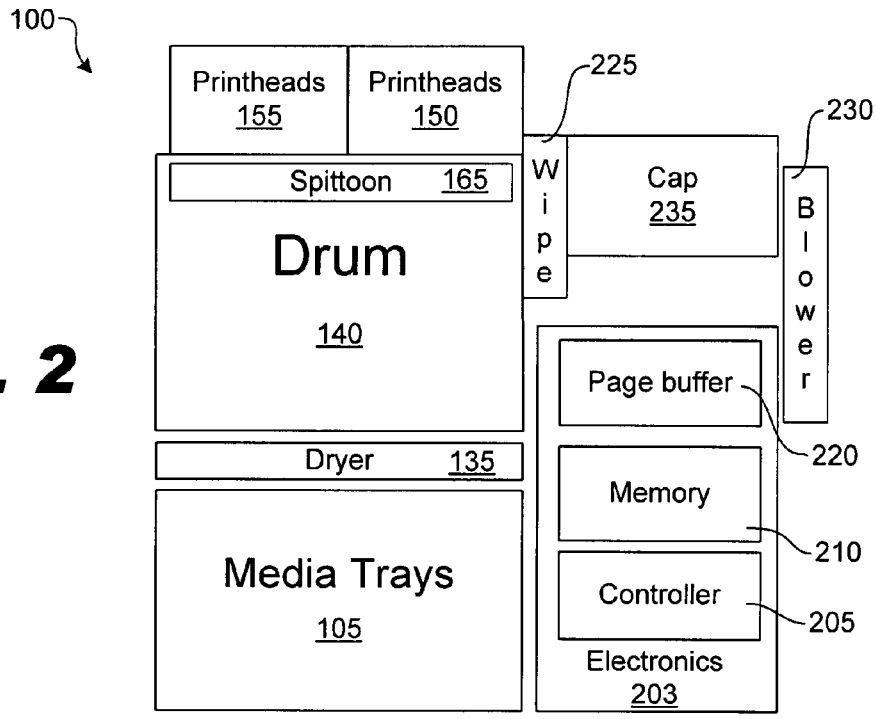
FIG. 2 is a block diagram of an exemplary printing system according to principles described herein.

Referring now to FIG. 2, a side view diagram of the drum-based inkjet printing system (100) of FIG. 1 is shown. As can be seen from the figure, the printing system (100) further includes a blower (230). The blower (230) may blow air from inside the drum (140) to create the vacuum that helps hold sheets of print media to the exterior of the drum (140).

The printheads (150, 155) may also include a wipe (225) that mechanically wipes the exterior of the printheads (150, 155) to remove excess or drooling ink that may have collected on the exterior of the printheads (150, 155). During periods of inactivity, the printheads (150, 155) may also include a cap (235) that caps the nozzles of the printheads (150, 155) to prevent ink drooling and to maintain desired environmental conditions, such as sufficient humidity, inside the printhead nozzles.

Additionally, the printing system (100) includes electronics (203) to receive and process document data and convert that data into a format used by the printheads (150, 155). The electronics (203) may include a controller (205) and a memory (210). The memory (210) stores document data that has been received from a host computer or other printer client. The data stored in memory (210) may include individual page data, the pages having an original sequence. Data corresponding to individual pages may be received into a page buffer (220) that holds the data for a set number of pages.

The controller or controller circuitry (205) may include application specific integrated circuits (ASICs), microcontrollers, or other processing elements. Examples of functions that may be performed by the controller circuitry (205) include, but are not limited to, processing and converting data as it is received into the memory (210) of the printing system (100), maintaining the page buffer (220), determining an amount of time on the drum (140) required by each page in the buffer (220) to print, determining an optimal page order for the buffer (220), controlling printhead (150, 155) operation, controlling drum rotation, controlling dryer and media tray operation, performing user interface operations, and other functions.

Exemplary Drum

Figure 3:
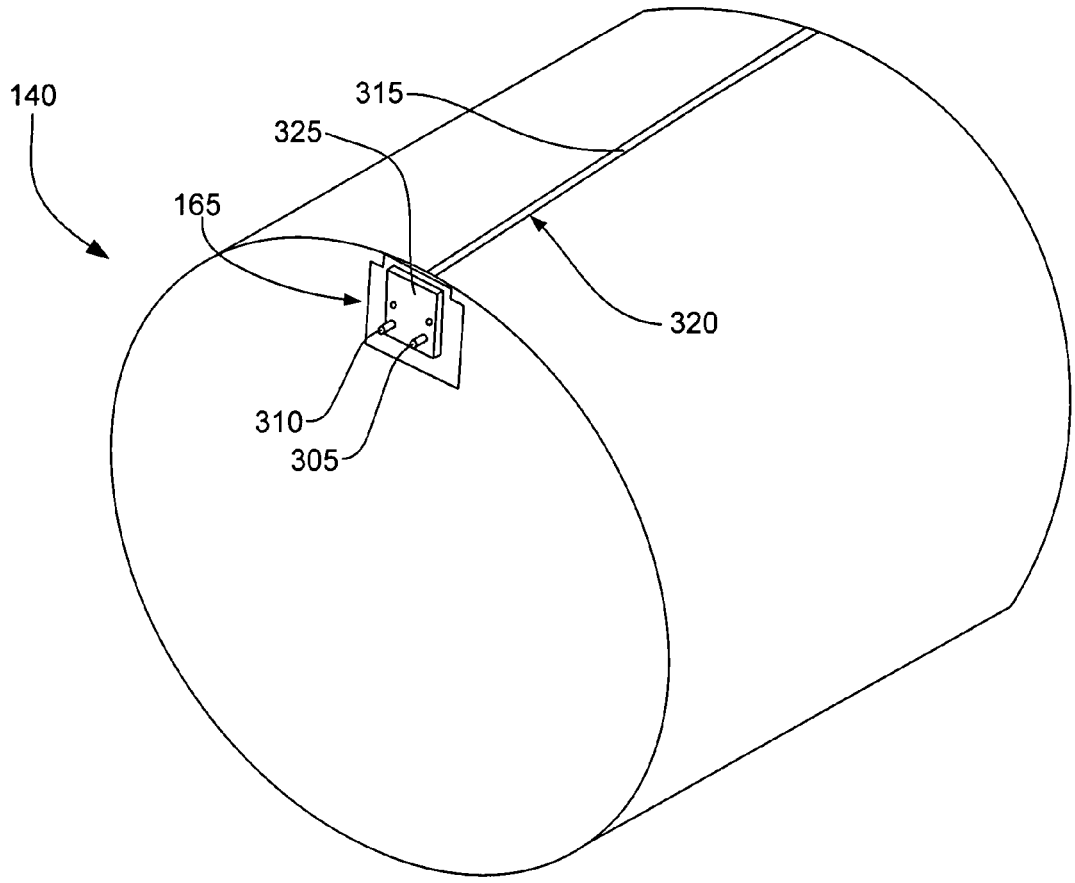
FIG. 3 is an illustration of an exemplary printing drum, according to principles described herein.

Referring now to FIG. 3, an exemplary print drum (140) is shown. The exemplary print drum (140) is configured to rotate as one or more pages of print media are adhered to the outer periphery of the drum (140). As the drum (140) rotates, the pages of print media may be cycled through various phases of a printing process.

The exemplary print drum (140) includes a replaceable printhead spittoon (165) disposed within a longitudinal slot (320) in the drum (140). The printhead spittoon (165) is configured to receive liquid ink from printhead decap spitting operations. To accomplish this, the spittoon (165) presents an exposed portion of a rolled sheet or web of absorbent material (315) that, when the spittoon (165) is loaded into the drum (140), is accessible to the printheads for spitting through an open slot (320) across the outer surface of the drum (140).

By equipping the print drum (140) with a spittoon (165) that is disposed in the drum (140), print operations need not be significantly interrupted to move the printheads to a spittoon away from the drum when a spitting operation is needed to maintain printhead health. Furthermore, in many embodiments, lateral movement by the printheads may not be required during a spitting operation because the slot (320) providing access to the absorbent material (315) in the spittoon (165) substantially extends from one end or circular face of the drum (140) to the other, thereby providing absorbent material (315) all along the range of lateral movement of printheads over the drum (140).

The spittoon (165) of this embodiment also includes an interface plate (325) having first and second knobs (305, 310). The interface plate (325) provides control of rollers within the spittoon used to manipulate the roll of absorbent material (315). By turning one or both of the first and second knobs (305, 310), absorbent material (315) may be advanced from one roller to another, thus exposing a new, clean portion of absorbent material (315) when a previous portion has become saturated with ink during spitting operations. In some embodiments, a printing system may be equipped to periodically advance the absorbent material (315) based on the passage of time, indications from sensors (312, FIG. 4), printhead usage, or the like.

When the spittoon (165) has used up its entire length of absorbent material (315) for decap spitting operations of the printheads, the spittoon may be replenished. This may be accomplished by removing the used spittoon (165) from the longitudinal slot (320) and sliding a new spittoon into the longitudinal slot (320) of the drum (140). Alternatively, the spittoon (165) may be removed, the roll of absorbent material (315) in the spittoon (165) replaced and the spittoon (165), including the new roll of absorbent material, re-installed in the drum (140).

In some embodiments, a printing system may detect and notify a user that the spittoon (165) requires maintenance, for example, when the roll of absorbent material has been entirely advanced from a first roller to second roller within the spittoon. Such detection may occur by the printing system measuring mechanical resistance or tension in rotating one or both of the knobs (305, 310), comparing a measured amount of rotation of one or both of the knobs (305, 310) to a given value, sensors, or by other means.

Exemplary Spittoon

Figure 4:
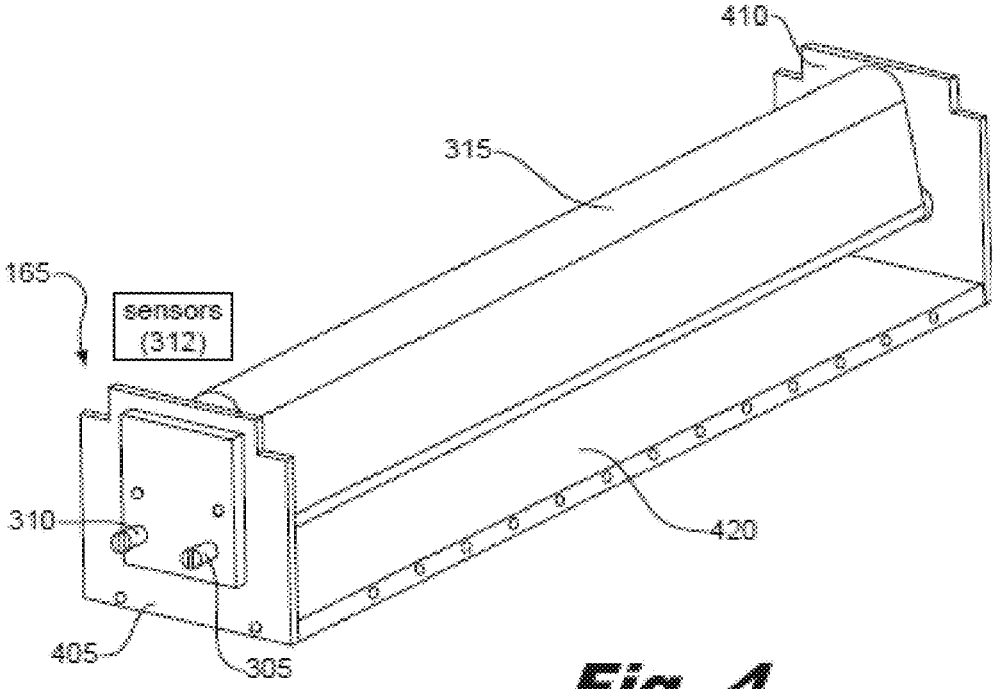
FIG. 4 is an illustration of an exemplary replaceable printer spittoon, according to principles described herein.

Referring now to FIG. 4, an exemplary replaceable printhead spittoon (165) is shown in more detail. The printhead spittoon (165) includes a frame having a longitudinal piece (420) connecting first and second faces (405, 410, respectively). The first and second faces (405, 410) and the longitudinal piece are configured to be received in a recess of a print drum having a corresponding geometry, such as illustrated and described above. In this manner the spittoon (165) may be slid in and out of the print drum. In some embodiments, the printhead spittoon (165) may include a locking mechanism to secure the spittoon (165) into its correct position in the drum.

The first and second opposing faces (405, 410) provide housing to rollers controlled by the first and second knobs (305, 310). As illustrated and explained above, when the exemplary replaceable printhead spittoon (165) is loaded into a print drum, a strip of the absorbent material (315) on the rollers is exposed to the printheads through a slit in the outer surface of the print drum. With each rotation of the drum, the spittoon and its strip of exposed absorbent material (315) pass by the printheads and may consequently be used for a spitting operation. As the exposed portion of the absorbent material (315) becomes soiled with ink from printhead spitting operations, one or both of the knobs (305, 310) may be turned such that the absorbent material (315) is advanced from one roller to another, thus exposing a clean portion of the absorbent material (315) to the outer periphery of the print drum.

The absorbent material (315) may comprise a natural or synthetic fabric capable of being stored and advanced by a system of rollers. In some embodiments, the absorbent material is an absorbent web fabric.

Figure 5:
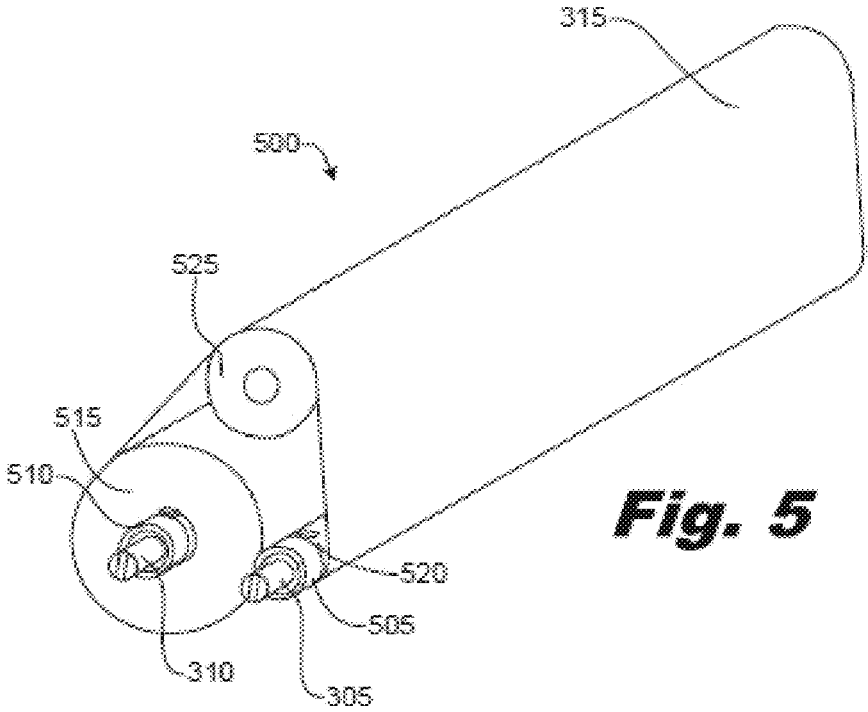
FIG. 5 is an illustration of an exemplary replaceable printer spittoon, according to principles described herein.

Referring now to FIG. 5, the exemplary replaceable printhead spittoon (165) is shown with elements of the frame removed to better illustrate a system of rollers (505, 510, 525). The rollers (505, 510, 525) include a collection roller (505), a spit roller (525), and a supply roller (510).

The supply roller (510) includes a supply (515) of clean, unused absorbent material (315) which may be transferred from the supply roller (510) to the spit roller (525) and eventually to the collection roller (505) by rotation of knobs (305, 310). The collection roller (505) stores the quantity (520) of used absorbent material (315).

The spit roller (520) is configured to position a portion of the absorbent material (315) underneath one or more printheads for use during spitting operations, as previously explained. As the absorbent material (315) becomes soiled by the liquid ink from printhead spitting, the portion of absorbent material wrapped around the spit roller (525) may be advanced toward the collection roller (505) as fresh, clean absorbent material from the supply roller (510) is positioned over the spit roller (525) and underneath the printhead(s).

In some embodiments, the position of one or more of the rollers (505, 510, 525) with respect to each other, a print drum, or a printhead may be adjusted to provide optimal spitting conditions. For example, the spit roller (525) may be moved to position the exposed portion of the absorbent material (315) at an optimum distance from printheads to minimize or eliminate aerosol generation during decap spitting.

In embodiments where the absorbent material (315) may be advanced automatically by a printing system, an internal or external drive system may be used to turn the knobs (305, 310) of the collection and supply rollers (505, 510). An internal drive system may be part of the spittoon and drum, which allows the advancement of the absorbent material (315) at any time. With an external drive system, the drum may be rotated to a particular position where the external driving system can engage the spittoon and advance the absorbent material (315). Internal or external drive systems may include motorized devices to turn the knobs (305, 310) and/or rollers (505, 510). A passive system may also advance the absorbent material (315), such as an indexing mechanism that is actuated by rotation of the print drum.

Exemplary Printing System

Figure 6:
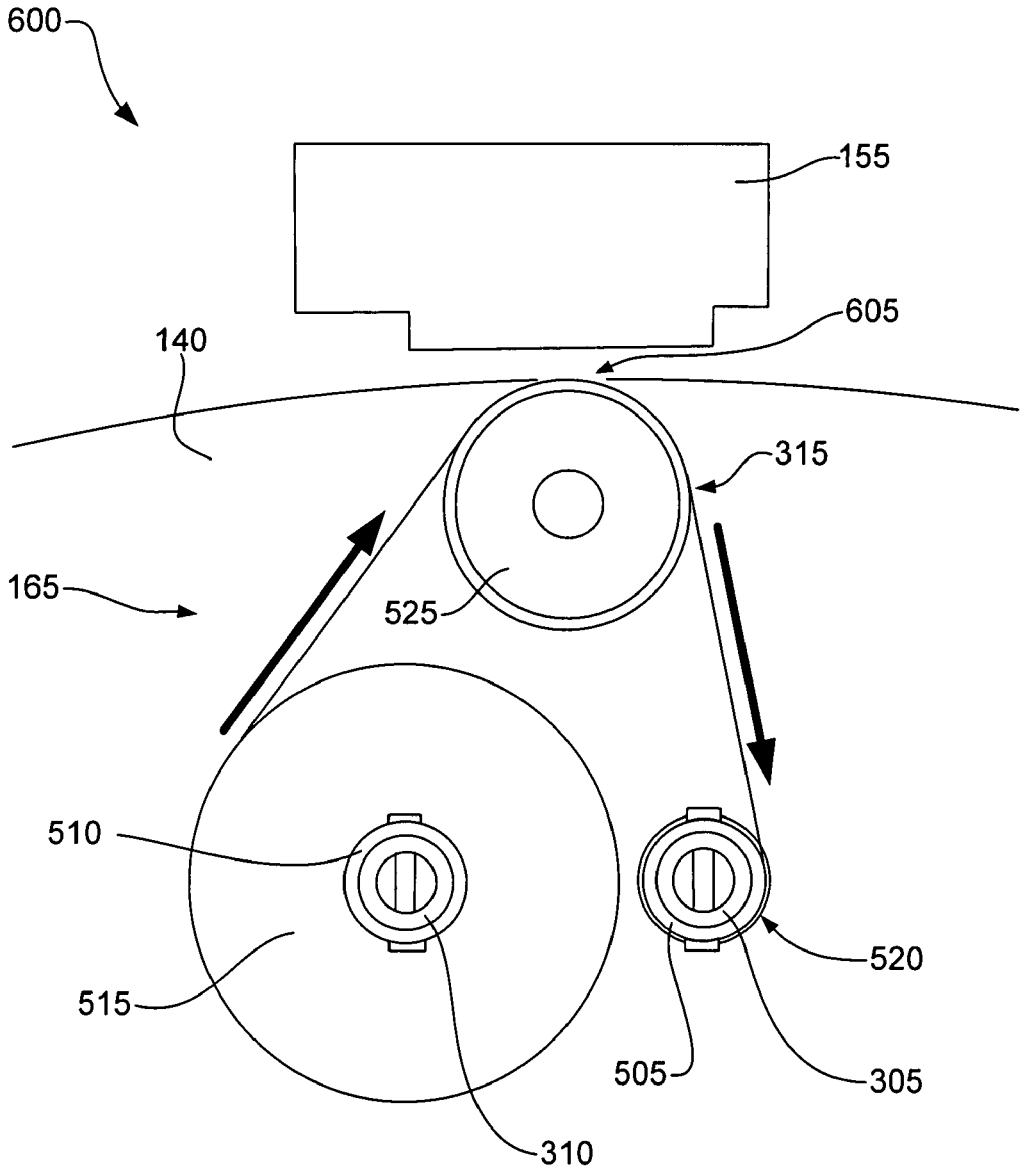
FIG. 6 is an illustration of an exemplary printing system, according to principles described herein.

Referring now to FIG. 6, an exemplary printing system (600) is shown. The printing system (600) includes a printhead (155) and a print drum (140). A printhead spittoon (165) is disposed within the print drum (140) and includes a supply roller (510), a spit roller (525), and a collection roller (505). An absorbent material (315) may be transferred from the supply roller (510) to the spit roller (525) to the collection roller (505) by driving the rollers, for example, by rotating knobs (305, 310) connected respectively to the collection roller (505) and/or the supply roller (510).

The printhead spittoon (165) includes an exposed portion (605) of absorbent material (315) configured to form part of the outer periphery of the print drum (140). The exposed portion (605) of the absorbent material (315) is configured to receive liquid ink droplets from the printhead (155) during decap spitting operations. The exposed portion (605) of the absorbent material (315) may remain substantially stationary with respect to the print drum (140) until the exposed portion (605) of the absorbent material (315) becomes sufficiently soiled as to require the advancement of additional absorbent material (315) from the supply roller (510) to the spit roller (525).

As described above, the printhead print drum (140) is configured to rotate print media under the printheads and through other stages of a printing cycle. During such rotations, the print drum (140) is configured to position the spittoon (165) directly beneath the printhead (155). In some embodiments, the distance between the exposed portion (605) of the absorbent material (315) and the printhead (155) may be adjusted to provide optimal printhead decap spitting conditions.

Figure 7:
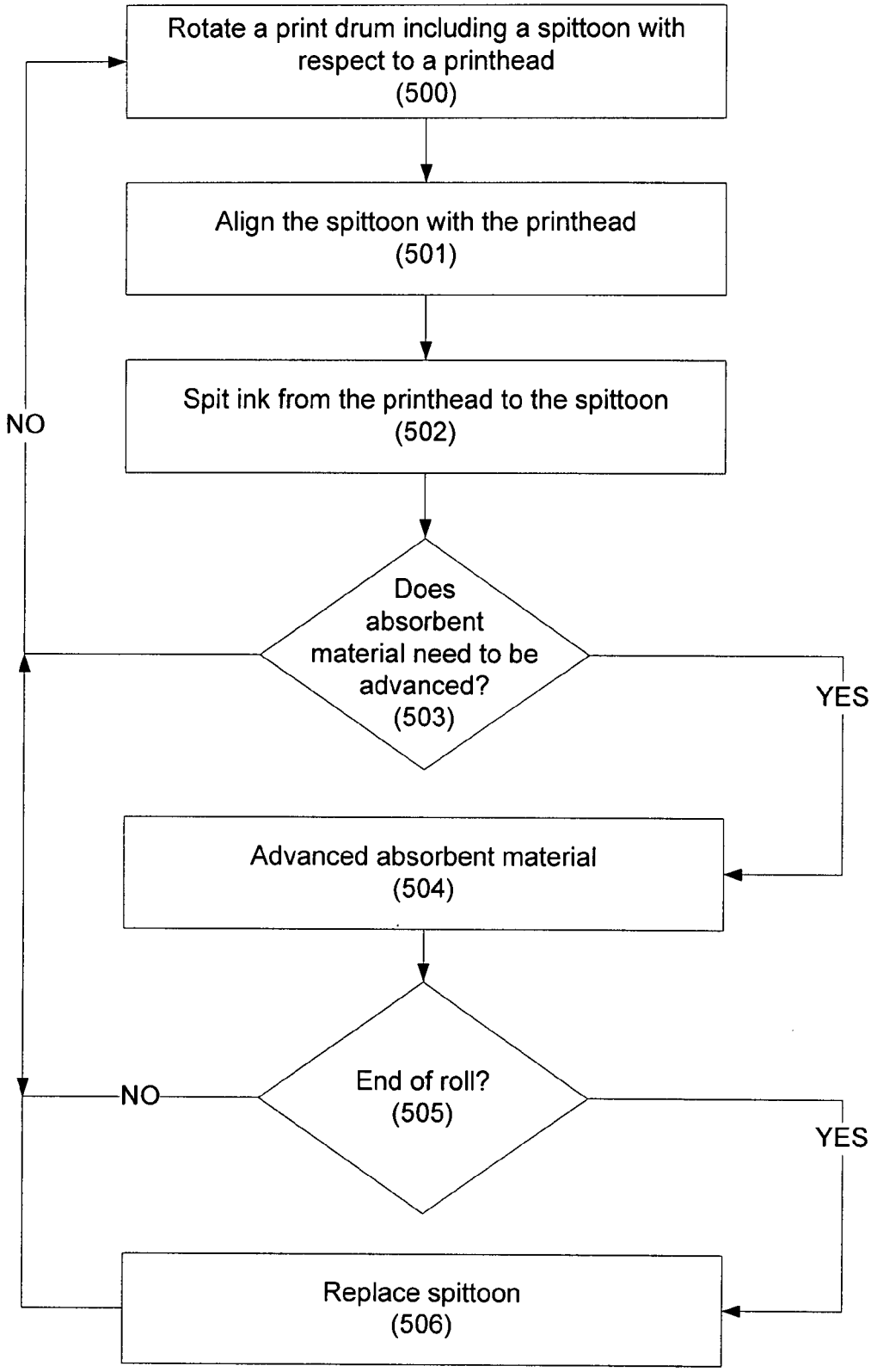
FIG. 7 is a flowchart illustrating a method of operating a printing system with a spittoon according to principles described herein.

FIG. 7 is a flowchart illustrating a method of operating a printing system and spittoon according to principles described herein. As shown in FIG. 7, the print drum which includes a spittoon, such as that described above, is rotated with respect to a printhead (step 500). As the drum rotates, printing operations can be conducted.

When a decap spitting operation is needed to clean the nozzles or jets of the printhead, the drum is rotated so as to align the spittoon with the printhead (step 501). Ink is then spit from the printhead as needed (step 502).

As described above, the spittoon may include a sheet or other configuration of absorbent material that can be advanced to provide clean material for additional spitting operations. The method may determine whether the absorbent material needs to be advanced (determination 503). As indicated above, this can be determined by the controller of the printing system based on how much ink has been expelled in decap spitting operations since the absorbent material was last advanced. The controller can then make a determination as to whether the absorbent material needs to be advanced again and, advanced the absorbent material (step 504) as needed.

The method may also determine when no more absorbent material remains to be advanced into position for decap spitting operations (determination 505). As explained above, this may be done by sensing the tension on the rollers bearing the absorbent material in the spittoon. Alternatively, the system controller may simply track how many times the absorbent material has been advanced and compare that quantity with a known amount of absorbent material in the spittoon and the amount consumed by each advancement. In this way, the controller can sense or determine when the clean absorbent material is exhausted.

When no more absorbent material remains to be used (determination 505), the spittoon can be replaced (step 506). As noted above, this may involve replacing the entire spittoon or merely replacing the supply of absorbent material within the spittoon.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A printing system comprising:

a printhead;

a print drum for transporting print media in said printing system including to said printhead; and a spittoon comprising a sheet of absorbent material wound on at least one roller disposed on said print drum for receiving ink from a decap spitting operation of said printhead, wherein said spittoon comprises a quantity of material for receiving said ink and periodically repositions said material with respect to said printhead.

2. The system of claim 1, wherein said spittoon is configured to fit in a corresponding recess in said print drum.

3. The system of claim 2, wherein said recess comprises a slot arranged longitudinally across a surface of said drum such that said spittoon presents a strip of absorbent material through said slot to said printhead for said decap spitting operation.

4. The system of claim 2, wherein said recess comprises a slot with a first width in a surface of said print drum and a cavity with a second, larger width in said print drum, said cavity communicating through said slot with said surface of said print drum, said spittoon being disposed in said cavity so as to present a portion of said sheet of absorbent material at said slot.

5. The system of claim 1, wherein said spittoon comprises:

a first roller configured to position the absorbent material beneath said printhead;

a second roller configured to provide clean absorbent material to said first roller; and a third roller configured to store used absorbent material received from said first roller.

6. The system of claim 5, further comprising a drive for driving one or more of said rollers, wherein said system is configured to automatically advance absorbent material from said second roller to said first roller, and from said first roller to said third roller.

7. The system of claim 5, further comprising a sensor for sensing when said second roller has no more clean absorbent material to provide to said first roller.

8. The system of claim 1, further comprising a sensor for sensing when said spittoon needs to be replaced.

9. A spittoon for collecting ink from a printhead during a spitting operation, said spittoon comprising a sheet of absorbent material wound on rollers.

10. The spittoon of claim 9, wherein said spittoon comprises:

a first roller configured to position the absorbent material beneath a printhead;

a second roller configured to provide clean absorbent material to said first roller; and a third roller configured to store used absorbent material received from said first roller.

11. The spittoon of claim 10, further comprising a drive for driving one or more of said rollers, wherein said drive is configured to automatically advance absorbent material from said second roller to said first roller, and from said first roller to said third roller.

12. The spittoon of claim 10, further comprising a sensor for sensing when said second roller has no more clean absorbent material to provide to said first roller.

13. The spittoon of claim 9, further comprising a sensor for sensing when said spittoon needs to be replaced.

14. The spittoon of claim 9, wherein said spittoon is configured to fit in a recess disposed across a surface of a print drum such that said spittoon presents a strip of said absorbent material to a printhead for said spitting operation.

15. A method of performing a spitting operation for a printhead, said method comprising:

rotating a print drum with respect to said printhead, wherein said drum comprises a spittoon disposed on said drum for receiving ink ejected from said printhead during said spitting operation;

aligning said spittoon on said drum with said printhead;

spitting ink with said printhead to a sheet of absorbent material wound on rollers within said spittoon.

16. The method of claim 15, further comprising disposing said spittoon within a recess in said print drum.

17. The method of claim 16, wherein said recess comprises a slot across a surface of said print drum such that said spitting ink with said printhead to said spittoon can be performed anywhere across a width of said print drum.

18. The method of claim 15, further comprising advancing said sheet of absorbent material on said rollers within said spittoon to present clean absorbent material to said printhead for spitting.

19. The method of claim 18, further comprising sensing an end of said rolled sheet of absorbent material in said spittoon.

20. The method of claim 18, further comprising automatically determining when to advance said rolled sheet of absorbent material.

* * * * *